United States Patent [19]

Wagle et al.

[11] Patent Number: 4,919,758

[45] **Date of Patent: * Apr. 24, 1990**

[54] HEAT TREATMENT OF PAPER PRODUCTS HAVING STARCH ADDITIVES

[75] Inventors: Dinkar G. Wagle, Monroe; Vacheslav M. Yasnovsky, Orangeburg, both of N.Y.

[73] Assignee: International Paper Company, Purchase, N.Y.

[ * ] Notice: The portion of the term of this patent subsequent to Apr. 4, 2006 has been disclaimed.

[21] Appl. No.: 102,699

[22] Filed: Sep. 30, 1987

Related U.S. Application Data

[63] Continuation-in-part of Ser. No. 768,784, Aug. 23, 1985, abandoned.

[51] Int. Cl.[5] ..... D21H 3/28

[52] U.S. Cl. ..... 162/175; 162/207

[58] Field of Search ..... 162/204, 206, 207, 175, 162/174, 135, 202, 168.1

[56] References Cited

U.S. PATENT DOCUMENTS

| | | | |
|---|---|---|---|
| 2,116,544 | 5/1938 | Schur | 162/206 |
| 2,670,663 | 3/1954 | Wenzelberger et al. | 162/175 |
| 3,067,088 | 12/1962 | Hofreiter et al. | 162/175 |
| 3,794,558 | 2/1974 | Back | 162/175 |
| 3,908,071 | 9/1975 | Heim et al. | 162/175 |

FOREIGN PATENT DOCUMENTS

| | | | |
|---|---|---|---|
| 566365 | 11/1958 | Canada | 162/175 |
| 1424682 | 2/1976 | United Kingdom | 162/206 |

OTHER PUBLICATIONS

Back et al, "Wet Stiffness by Means of Heat Treatment of Running Web", *Pulp & Paper Canada,* vol. 78, No. 11 (Nov. 1977), pp. T271–275.

*Primary Examiner*—Peter Chin

*Attorney, Agent, or Firm*—Walt Thomas Zielinski

[57] ABSTRACT

A paper product having high stiffness, wet strength, and opacity, and good folding endurance is produced by subjecting a paper web containing a starch additive to high temperature heat treatment.

2 Claims, No Drawings

HEAT TREATMENT OF PAPER PRODUCTS HAVING STARCH ADDITIVES

This application is a continuation-in-part of U.S. patent application Ser. No. 768,784, filed Aug. 23, 1985 now abandoned.

BACKGROUND OF THE INVENTION

1. Field of the Invention:

This invention relates to the art of papermaking, and particularly to a method of treating starch-containing paper product at high temperature to improve its properties, including dry and wet stiffness and wet tensile strength.

2. Description of the Prior Art:

In the art of papermaking, it is customary to subject felted fibers to wet pressing and then to drying on heated rolls.

There is currently considerable interest in improving various properties of paper and boards. Quantifiable paper properties include: dry and wet tensile strength, folding endurance, stiffness, compressive strength, and opacity, among others. Which qualities should desirably be enhanced depends upon the intended application of the product. In the case of milk carton board, for example, stiffness is of utmost importance, whereas for linerboard three qualities of particular interest to us are strength, folding endurance, and high humidity compression strength.

All of these properties can be measured by well-known standard tests. As used herein, then, "wet strength" means wet tensile strength as measured by American Society for Testing and Materials (ASTM) Standard D829-48. "Folding endurance" is defined as the number of times a board can be folded in two directions without breaking, under conditions specified in Standard D2176-69. "Stiffness" is defined as flexural rigidity and is determined in a standard TAPPI test as the bending moment in g-cm at a fifteen degree deflection angle. "Linerboard", is a medium-weight paper product used as the facing material in corrugated carton construction. Kraft linerboard is linerboard made according to the kraft process, and is well known in the industry. Folding carton board is a medium to heavy weight paper product made of unbleached and/or bleached pulps having basis weights from 40–350 g/m$^2$.

Prior workers in this field have recognized that high-temperature treatment of linerboard can improve its wet strength. See, for example E. Back, "Wet stiffness by heat treatment of the running web", *Pulp & Paper Canada,* vol. 77, No. 12, pp. 97–106 (December 1976). This increase has been attributed to the development and cross-linking of naturally occurring lignins and other polymers, which phenomenon may be sufficient to preserve product wet strength even where conventional synthetic resins or other binders are entirely omitted.

It is noteworthy that wet strength improvement by heat curing has previously been thought attainable only at the price of increased brittleness (i.e., reduced folding endurance). Embrittled board is not acceptable for many applications involving subsequent deformation, and therefore heat treatment alone, to develop the wet strength of linerboard and carton board, has not gained widespread acceptance. As Dr. Back has pointed out in the article cited above, "the heat treatment conditions must be selected to balance the desirable increase in wet stiffness against the simultaneous embrittlement in dry climates." Also, in U.S. Pat. No. 3,875,680, Dr. Back has disclosed a process for heat treating already manufactured corrugated board to set previously placed resins, wherein the specific purpose is to avoid running embrittled material through a corrugator.

It is plain that improved stiffness and wet strength, on one hand, and improved folding endurance, on the other, were previously thought to be incompatible results.

Every year, the paper industry consumes millions of pounds of starch—an inexpensive natural polymer closely related to cellulose in chemical composition. Preparations of starch are added to papers and board compositions principally to improve their dry strength and their surface properties (J. P. Casey, Pulp and Paper, 3rd edition, pp. 1475–1500, 1688–1694, 1981). However, despite the well-known uses of starch, and of heat treating, separately, papers containing starch have not previously been heat treated to improve wet strength. Indeed, one of ordinary skill would not have expected heat treatment to improve starched paper, since unlike protein, starch does not cross-link when heat is applied.

We have found that heat treatment unexpectedly improves the wet strength of papers and boards containing starch. In its broadest sense, the invention comprises steps of (1) adding starch preparation into the pulp slurry or onto surface of formed paper or board; and then (2) heating the said paper or board to an internal temperature of at least 400° F. (205° C.) for a period of time sufficient to increase the wet strength of the product.

This method produces a product having folding endurance greatly exceeding that of similar product whose stiffness and wet strength have been increased by heat alone, or by starch addition alone. This is clearly shown by the results of our tests, reported below.

If starch is added to the surface of a web, it may be in its native anionic form. However, when starch is added to an aqueous slurry, we prefer to render it cationic, and therefore more soluble, by pretreating it with quaternary ammonium ion salts to give the starch chains net positive charges. Such salts do not affect the paper strength.

We prefer to raise the internal temperature of the board to at least 450° F. (232° C.) during the heat treating step, as greater stiffness and wet strength are then achieved. This may be because at higher temperatures, shorter step duration is necessary to develop bonding, and there is consequently less time for fiber degradation to occur. Also, shorter durations enable one to achieve higher production speeds.

While the invention may be practiced over a range of temperatures, pressures and duration, these factors are interrelated. For example, the use of higher temperatures requires a heat treating step of shorter duration, and vice-versa. For example, at 550° F. (289° C.), a duration of 2 seconds has been found sufficient to obtain the desired improvements, while at 420° F., considerably longer is required.

As an additional step, we prefer to rewet the product, immediately after the heat treatment, to at least 1% moisture by weight. These steps are followed by conventional drying and/or conditioning of the treated product. Of course, those skilled in the art will recognize the necessity of conditioning to a normal moisture content after treatment at high temperature. See, for example, U.S. Pat. No. 3,395,219. A certain amount of rewetting is normally done, and in fact product properties are never even tested prior to conditioning. All conventional rehumidification is done after the product has substantially cooled.

Our rewetting treatment principally differs from conditioning in that we add water, by spraying or otherwise, to a very hot and dry paper or board at the very end of the heat treatment, without intermediate cooling. It is important that water be applied to the product while it is still hot, certainly above 100° C. (212° F.), and preferably above 205° C. (400° F.). Another heat treatment or drying step may follow rewetting, on or off the machine, during a subsequent operation such as sizing, coating or calendering.

DESCRIPTION OF THE PREFERRED EMBODIMENT

As a first step in carrying out the invention, a starch solution is added either to the paper pulp, prior to forming, or to a formed web by sizing or in any of various ways known in the art.

The water content of the web must first be reduced to at most 40% by weight and preferably to within the 10–15% range.

The heat treating and rewetting steps are then carried out, preferably on a papermaking machine, although the test data shown below was developed on a static press in a laboratory. In the heat treating step, sufficient heat is applied to the board to achieve an internal paper temperature of at least 400° F. (205° C.). The heat can be applied in the form of hot air, superheated steam, heated drying cylinders, infrared heaters, or by other means.

Alternatively, the invention may be practiced by heating paper product in an oven after a size-press. The internal temperature of the board should be brought to at least 400° F. for at least 10 seconds. Again, the nature of the heat source is not important.

Following the heat treating step, and while the paper is still hot, water is applied to it, preferably by spraying. Even though one effect of the water application is to cool the paper, it is important that the paper not be allowed to cool substantially before the water application.

The heat treated and rewetted paper is then cooled, conditioned, and calendered according to conventional procedure. The invention has been practiced as described in the following examples. The improvement in board quality will be apparent from an examination of the test results listed in the tables below.

EXAMPLE 1

A commercial bleached kraft board ("C" in the tables) was wetted to contain 10.5% moisture by weight and heat treated at 410° F. (210° C.) for 26.5 seconds ("HT"). The board was conditioned for 48 hours under standard (70° F., 65% relative moisture) conditions. Resultant board properties are listed in Table I.

TABLE I

| Properties | Control Board (C) | Heat Treated Example 1 (HT) |
|---|---|---|
| Basis weight (lb/3000 ft$^2$) | 139.5 | 136.3 |
| Caliper (mils) | 15.1 | 15.6 |
| Taber stiffness (gm-cm) corrected for basis weight | 90/38 | 86/36 |

TABLE I-continued

| Properties | Control Board (C) | Heat Treated Example 1 (HT) |
|---|---|---|
| Stiffness improvement % | — | −4/−5 |
| Dry Tensile lb/in (MD/CD) | 45/26.1 | 43.5/30.7 |
| Wet Tensile, lb/in (MD/CD) | 1.6/1.1 | 4.5/3.2 |
| Wet Strength Retention, % (MD/CD) | 3.6/4.2 | 10.3/10.4 |
| Cracking resistance % not cracked | 98/100 | 99/99 |
| MIT Fold, count | 55/38 | 39/43 |

EXAMPLE 2

The bleached kraft board in Example 1 was sized with corn starch (pick-up was 2.8 lb/3000 ft$^2$). One portion of the sized board was conventionally dried (110° C. for 9 seconds, "C" in the table). A second portion was heat treated at 410° F. (210° C.) for 28.8 seconds, without intermediate drying ("HT"). A third portion of the sized board was heat treated for 14.3 seconds under identical conditions, rewetted by a water spray on both sides to contain 15% moisture by weight and heat treated again for 14.3 seconds ("HT+RW"). The board was conditioned for 48 hours under standard conditions. Resultant board properties are listed in Table II. Notably, conventional drying did not improve the wet tensile of the sized board vs. the unsized one; however, both the wet tensile and stiffness of the heat-treated sized board is higher than that of the unsized board.

TABLE II

| Properties | Control Board (C) | Heat Treated (HT) | Twice Rewetted (HT + RW) |
|---|---|---|---|
| Basis weight (lb/3000 ft$^2$) | 140.5 | 144.6 | 141.8 |
| Caliper (mils) | 15.8 | 15.9 | 16.0 |
| Taber stiffness (gm-cm) | 122/71 | 136/71 | 134/66 |
| Stiffness improvement % | — | +11/0 | +10/−7 |
| Dry Tensile lb/in (MD/CD) | 68.0/43.7 | 70.4/41.6 | 70.3/43.2 |
| Wet Tensile, lb/in (MD/CD) | 1.8/1.3 | 5.6/3.9 | 3.7/2.3 |
| Wet Strength Retention, % (MD/CD) | 2.7/3.0 | 8.0/9.4 | 5.3/5.3 |
| Cracking resistance % not cracked | 99/100 | 21/86 | 96/99 |
| MIT Fold, count | 64/84 | 10/13 | 21/72 |

EXAMPLE 3

A mill sized (corn starch added at the mill, 2.4% pickup) bleached kraft board sample (C) was wetted to 10.9% moisture content and then treated at 410° F. (210° C.) for 15 seconds (HT). A portion of heat-treated board was rewetted and dried conventionally (HT & RW). All the samples were conditioned for 48 hours under standard conditions. Properties of these samples are given in Table III.

TABLE III

| Properties | Control Board (C) | Heat Treated (HT) | Rewetted (HT&RW) |
|---|---|---|---|
| Basis weight | 153.4 | 154.5 | 155.3 |

TABLE III-continued

| Properties | Control Board (C) | Heat Treated (HT) | Rewetted (HT&RW) |
|---|---|---|---|
| (lb/3000 ft$^2$) | | | |
| Caliper (mils) | 15.7 | 16.6 | 16.1 |
| Corrected stiffness | 121/60 | 132/60 | 133/67 |
| Stiffness improvement % | — | 9.1/0 | 9.9/11.7 |
| Dry Tensile (MD/CD) | 66.1/37.4 | 72.9/38.1 | 64.2/48.5 |
| Wet Tensile, (MD/CD) | 2.5/1.6 | 5.7/3.6 | 5.0/3.7 |
| Wet Strength Retention, % (MD/CD) | 6.6/4.4 | 14.9/9.4 | 10.3/7.5 |
| Cracking resistance % not cracked | 100/100 | 85/7 | 94/58 |

EXAMPLE 4

Three unbleached kraft linerboard samples (C) were sized with different amounts of corn starch and then heat treated at 406° F. (208° C.) for 30 seconds (HT). All the samples were conditioned for 48 hours under standard conditions. Resultant linerboard properties are given in Table IV. An improvement in wet strength in observable for the starch-sized samples; the improvement increases with increases in cornstarch addition.

TABLE IV

| Properties | CONTROL no HT | CONTROL HT | HEAT TREATED PLUS CORNSTARCH, % ADD-ON 0.3 | 0.6 | 1.0 |
|---|---|---|---|---|---|
| Basis weight (lb/1000 ft$^2$) | 42.7 | 42.8 | 42.6 | 43.5 | 43.4 |
| Caliper (mils) | 13.1 | 13.4 | 13.7 | 13.8 | 13.6 |
| Taber Stiffness (g-cm) | 92.5 | 100.5 | 91.7 | 94.5 | 94.5 |
| Dry Tensile, lb/in. | 105.3 | 87.7 | 89.9 | 93.9 | 97.7 |
| Wet Tensile, lb/in. | 7.9 | 13.8 | 14.6 | 16.8 | 18.2 |
| Wet Strength Retention, % | 7.5 | 15.7 | 15.5 | 17.9 | 18.6 |
| MIT Fold | 1702 | 2064 | 1389 | 1435 | 1740 |

EXAMPLE 5

A sample of never dried kraft linerboard grade pulp having a kappa number at 110 and Canadian Standard Freeness of 750 was slurried in water and various starch preparations were added to the slurry in the amount of 1% of the oven dried pulp weight. The starches were "cooked" in water according to conventional practice to contain 8% of starch by weight. A dispersion of the pulp fibers was converted to handsheets using 12×12 inch square sheet mold. The quantity of the fibers in the dispersion was adjusted to give a sheet weight of 19 grams in the oven dry state, said weight being close to that of an air dried, 42 lb/1000 ft$^2$ commercial linerboard sheet. The sheets were pressed at 60 psi prior to further treatments. A control sample (C) of handsheets was dried in a conventional dryer (Emerson speed dryer, model 10) at 230° F. (110° C.). The rest of the samples were heat treated at 428° F. (220° C.) for 15 seconds (HT). All the samples were conditioned for 48 hours under standard conditions. Resultant properties are listed in Table V. One can see that wet tensile of samples containing starch is higher than that of both control and heat treated samples not containing starch.

TABLE V

| Properties | NOT HEAT TREATED CONTROL | HEAT-TREATED WITH NO ADDITIVES | CATIONIC STARCH | CORN STARCH | POTATO STARCH | 50:50 POTATO STARCH: CAT. STARCH |
|---|---|---|---|---|---|---|
| Basis weight (lb/1000 ft$^2$) | 41.0 | 40.8 | 42.5 | 43.9 | 42.5 | 43.6 |
| Caliper (mils) | 13.4 | 12.8 | 13.3 | 13.8 | 13.1 | 13.9 |
| Taber Stiffness (gm-cm) | 103.3 | 93.0 | 127.5 | 121.0 | 89.0 | 113.0 |
| Dry Tensile, lb/in. | 6.5 | 13.2 | 20.4 | 15.8 | 20.9 | 15.2 |
| Wet Tensile, lb/in. | 0.5 | 2.1 | 4.0 | 2.2 | 4.6 | 2.1 |
| Wet Strength Retention, % | 8.0 | 15.6 | 19.7 | 13.7 | 22.2 | 13.8 |
| MIT Fold | 2108 | 1385 | 1172 | 803 | 479 | 1225 |

Inasmuch as the invention is subject to many variations and changes in detail, the foregoing description and examples should be taken as merely illustrative of the invention defined by the following claims.

We claim:

1. A method of improving the stiffness and wet strength of a kraft paper product comprising steps of:
   - incorporating a starch preparation consisting essentially of starch in aqueous solution into the paper product, the amount of starch added being in the range of 0.2% to 10% the weight of the paper product,
   - adjusting the moisture content of the paper product to within the range of 1% to 20% by weight,
   - heat treating said paper product at a temperature in the range of 284° F. to 482° F. for a period of time in the range of 0.5 to 120 seconds, and then
   - applying water to the product while the product remains at a temperature above 212° F., immediately after the heat treating step, to produce a final moisture content in the range of 1% to 20% by weight of the paper product.

2. The method of claim 1 wherein the amount of starch preparation added is in the range of 1 to 3% of the weight of the paper product.

* * * * *